US007516820B1

(12) United States Patent
Cox et al.

(10) Patent No.: US 7,516,820 B1
(45) Date of Patent: Apr. 14, 2009

(54) COLLAPSIBLE MULTIPLE ARM BAG HOLDER FOR A RETAIL CHECKOUT STATION

(75) Inventors: Aaron R. Cox, Tucson, AZ (US); Thomas J. Sluchak, Apex, NC (US); Robert P. Tennant, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 6 days.

(21) Appl. No.: 12/020,219

(22) Filed: Jan. 25, 2008

(51) Int. Cl.
*A63F 9/02* (2006.01)

(52) U.S. Cl. ..... 186/66; 248/95; 248/99; 383/6; 383/23; 383/34; 211/12; 211/85.15

(58) Field of Classification Search ..... 186/52, 186/66, 67; 705/16; 235/383, 439; 248/95–101, 248/122.1, 163.1, 200.1, 202.1, 261, 339–341, 248/424, 429; 383/6, 22–25, 33, 34; 211/12, 211/85.15, 85.19, 85.29, 96, 106, 119, 123, 211/168, 170, 171, 175
See application file for complete search history.

(56) References Cited

U.S. PATENT DOCUMENTS

| | | | | |
|---|---|---|---|---|
| 4,094,415 | A * | 6/1978 | Larson | 211/57.1 |
| 4,998,694 | A | 3/1991 | Barteaux | |
| 5,785,205 | A * | 7/1998 | Kerr et al. | 221/26 |
| 6,086,023 | A | 7/2000 | Kerr et al. | |
| 6,550,583 | B1 | 4/2003 | Brenhouse | |
| 6,990,463 | B2 * | 1/2006 | Walter et al. | 705/16 |

* cited by examiner

*Primary Examiner*—Jeffrey A Shapiro
(74) *Attorney, Agent, or Firm*—Cantor Colburn LLP; Randall Bluestone

(57) ABSTRACT

A retail checkout station includes a housing having at least a front wall, a first side wall and a second side wall, and a product scanning portion mounted to the housing. The product scanning portion includes a scanning device for scanning products purchased by a consumer. The checkout station also includes a collapsible multiple bag holder having a guide track mounted to at least one of the front wall, the first side wall and the second side wall of the housing. A plurality of bag support arms are shiftably mounted to the guide track. The plurality of bag holders extend outward from the guide track and are adapted to support a plurality of bags for holding items scanned at the product scanning portion.

4 Claims, 3 Drawing Sheets

COLLAPSIBLE MULTIPLE ARM BAG HOLDER FOR A RETAIL CHECKOUT STATION

BACKGROUND OF THE INVENTION

1. Field of the Invention

This invention relates to the art of retail checkout stations and, more particularly, to a retail checkout station having a collapsible multiple arm bag holder.

2. Description of Background

At present, most retail checkout stations, especially self-service checkout stations, rely on a rigid bag support mounted to a counter or platform near a scanner. In this manner, during a transaction, scanned items are placed in a bag on the rigid bag support. Typically, the rigid bag support includes a fixture that is capable of holding a single open bag. More specifically, while the fixture supports multiple bags, only a single bag is open for receiving items. Once a bag is filled, it is removed from the fixture, relocated, and a new bag is opened. In many cases, particularly at self-checkout stations, it is important (if not mandatory) for all bags to remain on the platform until the transaction is complete. That is, in self-checkout stations, the platform includes a scale that monitors a cumulative weight of purchased products. The cumulative weight is compared against data stored in a database for verification and/or security purposes.

In most retail establishments, the size (i.e., footprint) of the checkout station must remain small in order to conserve valuable floor space. As a result, users often times run out of free space to which full bags can be relocated. In many cases, only a single bag can be filled and weighed at self-checkout stations. As a result, customer flow is slowed and intervention by store personnel is required. That is, removal of a bag from scale triggers an alarm and a request that the bag be replaced. If the bag is not replaced, the transaction is delayed while store personnel provide assistance. Slow lines, and the need for store personnel to assist with the purchase, lead to consumer dissatisfaction and actually defeat any benefits realized by the use of self-checkout stations.

SUMMARY OF THE INVENTION

The shortcomings of the prior art are overcome and additional advantages are provided through the provision of a retail checkout station constructed in accordance with exemplary embodiments of the present invention. The retail checkout station includes a housing having at least a front wall, a first side wall and a second side wall, and a product scanning portion mounted to the housing. The product scanning portion includes a scanning device for scanning products purchased by a consumer. The retail checkout station also includes a user interface portion that is provided on the housing. The user interface portion includes a keypad and a display. The retail checkout station also includes a collapsible multiple arm bag holder having a guide track mounted to at least one of the front wall, the first side wall and the second side wall of the housing. The guide track includes a first end portion that extends to a second end portion through an intermediate portion. A plurality of bag support arms are shiftably mounted to the guide track. The plurality of bag support arms extend outward from the guide track and are adapted to support a plurality of bags for holding items scanned at the product scanning portion.

Additional features and advantages are realized through the techniques of exemplary embodiments of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the exemplary embodiments of the invention, together with advantages and features, by way of example with reference to the drawings.

DETAILED DESCRIPTION OF THE INVENTION

Figure 1:
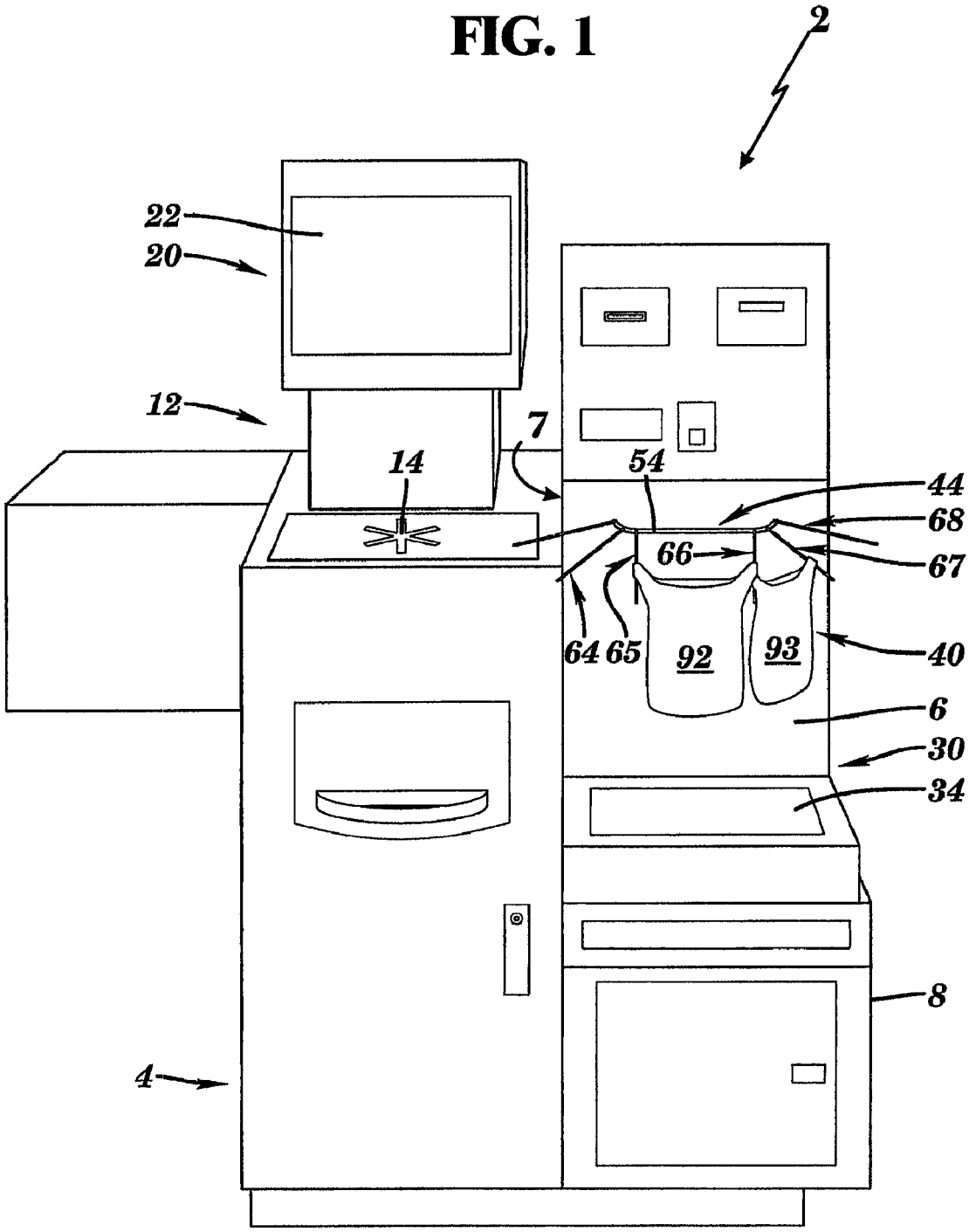
FIG. 1 is a front view of a retail checkout station including a collapsible multiple arm bag holder constructed in accordance with an exemplary embodiment of the present invention.

With initial reference to FIG. 1, a retail checkout station constructed in accordance with an exemplary embodiment of the present invention is generally indicated at 2. Checkout station 2 includes a housing 4 having a front wall 6, a first side wall 7 and a second side wall 8. As shown, checkout station 2 also includes a product scanning portion 12 having a scanning device 14 that is configured to scan or read product identification codes, such as Universal Product Code (UPC), industrial symbol(s), alphanumeric character(s) or other indicia associated with items to be purchased. In addition, checkout station 2 includes a user interface 20 having a display 22. User interface 20 provides information to customers conducting a transaction at checkout station 2 such as, providing a listing of products scanned, selection of payment type, and the like. Once scanned, an item is either moved to a belt (not shown) for transport to a bagging area or placed directly in a bag. In the exemplary embodiment shown, checkout station 2 includes a bagging platform 30 having a scale 34. Scale 34 determines a weight of products placed on bagging platform 30 for verification and security purposes.

Figure 2:
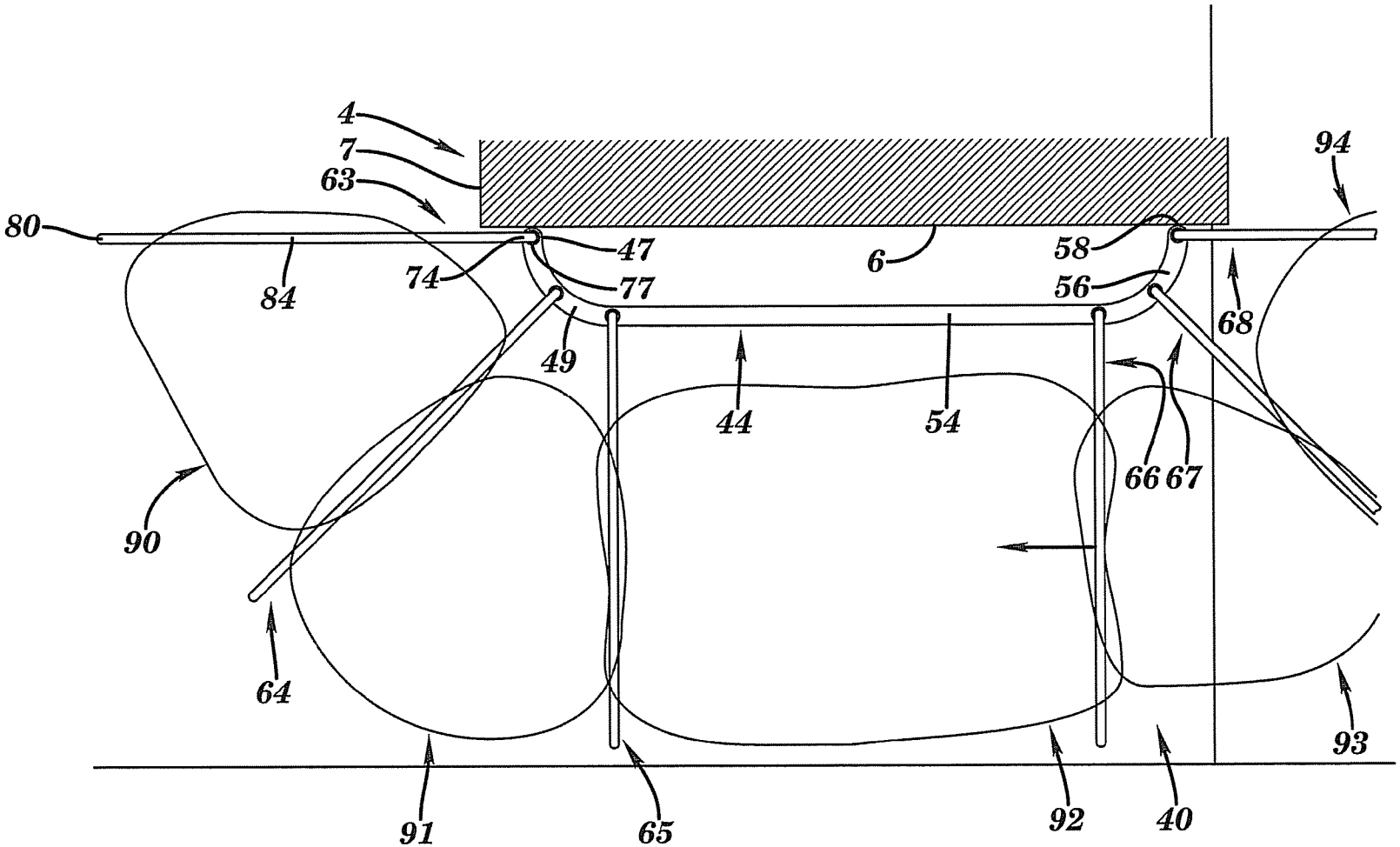
FIG. 2 is a top schematic view of the collapsible multiple arm bag holder of FIG. 1.

In accordance with an exemplary embodiment of the present invention, checkout station 2 includes a collapsible multiple bag holder 40 provided at bagging platform 30. As best shown in FIG. 2, bag holder 40 includes a guide track 44 mounted to front wall 6 of housing 4. Guide track 44 includes a first end portion 47 that extends to a first curved portion 49. First curved portion 49 leads to an intermediate portion 54. Intermediate portion 54 extends to a second curved portion 56 that terminates at a second end portion 58. In further accordance with the embodiment shown, multiple bag holder 40 includes a plurality of bag support arms 63-68 slideably mounted to guide track 44. As each bag support arm 63-68 is constructed similarly, a detailed description will follow with respect to support arm 63 with an understanding that the remaining support arms, i.e., support arms 64-68, are similarly formed. As shown, support arm 63 extends laterally outward from guide track 44. Towards that end, support arm 63 includes a first end section 74 having a glide member 77, a second, cantilevered, end section 80 and an intermediate section 84. Glide member 77 allows support arm 63 to easily shift along glide track 44 while first and second curved portions 49 and 56 allow bag support arms 63-68 to fan out along guide track 44 in order to establish a desired spacing to facilitate loading bags as will be discussed more fully below.

In accordance with the exemplary embodiment shown in FIG. 2, collapsible bag holder 40 includes a plurality of bags 90-94 mounted on support arms 63-68. More specifically, bag 90 is mounted on support arm 63 and adjacent support arm 64, bag 91, is mounted on support arm 64 and adjacent support arm 65, bag 92 is mounted on support arm 65 and adjacent support arm 66, bag 93 is mounted on support arm 66 and adjacent support arm 67 and bag 94 is mounted on support arm 67 and adjacent support arm 68. With this configuration, as each bag is filled, a new bag can be mounted to bag holder 40. Moreover, the bag that is filled is shifted along guide track 44 thus allowing the new bag to be positioned centrally at bagging platform 30. In this manner, bags are spread out in an array or fan-like pattern along guide track 44 and consumers are no longer limited to a single bag, or, when multiple bags are needed, no longer require assistance from store personnel to complete a transaction.

Figure 3:
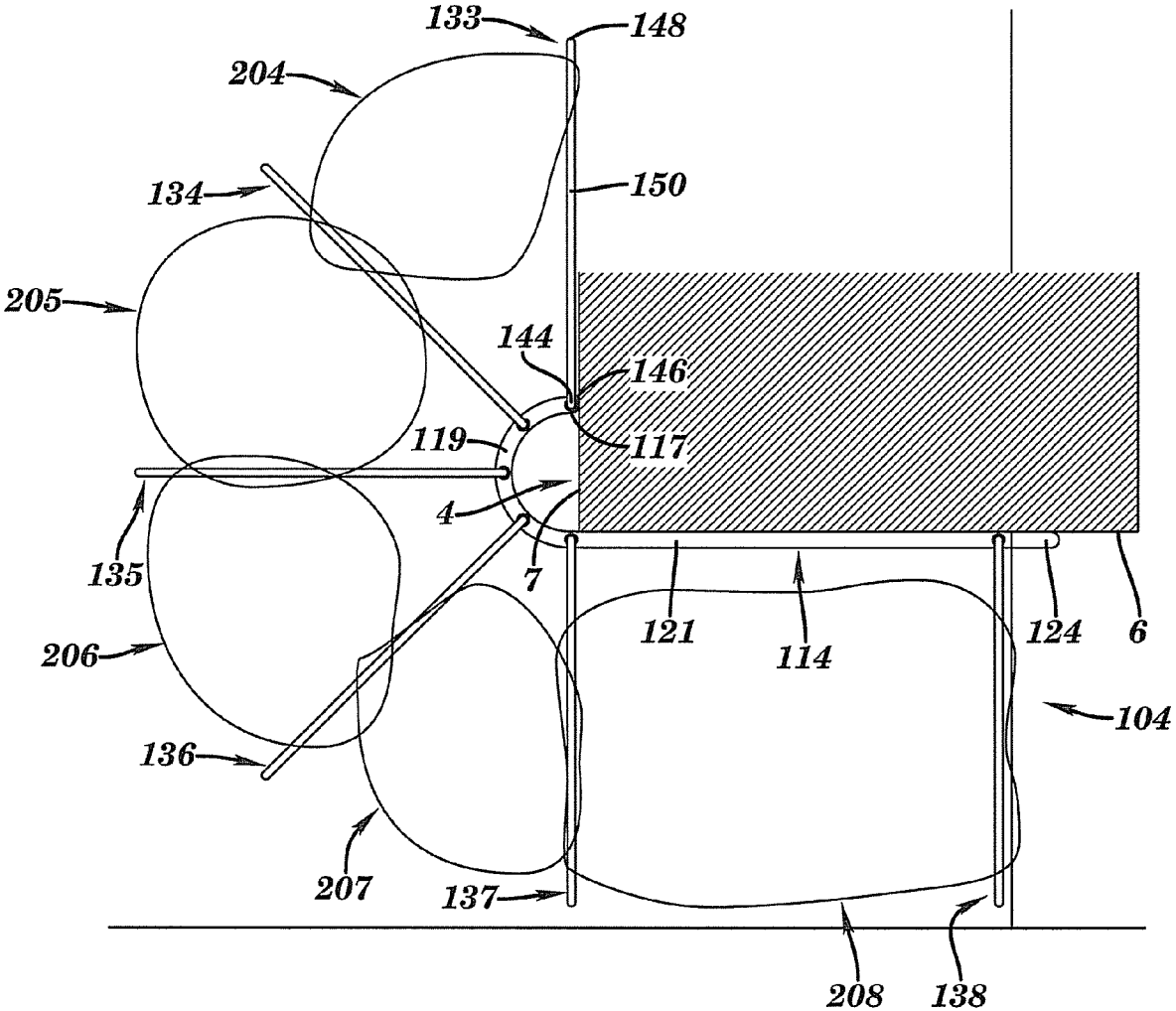
FIG. 3 is a top schematic view of a collapsible multiple arm bag holder constructed in accordance with another exemplary embodiment of the present invention.

Reference will now be made to FIG. 3, where like referenced numbers represent corresponding parts in the respective views, in describing a collapsible multiple bag holder 104 constructed in accordance with another exemplary embodiment of the present invention. Bag holder 104 includes a guide track 114 having a first end portion 117 that extends to a curved portion 119 that transitions to an intermediate portion 121. Intermediate portion 121 leads to a second end portion 124. As shown, curved portion 119 wraps around a corner of housing 4 established between side wall 7 and front wall 6 such that guide track 114 extends along multiple adjacent surfaces.

In a manner similar to that described above, bag holder 114 includes a plurality of bag support arms 133-138 slideably mounted to guide track 114. As each bag support arm 133-138 is constructed similarly, a detailed description will follow with respect to support arm 133 with an understanding that the remaining support arms, i.e., support arms 134-138, are similarly formed. As shown, support arm 133 extends laterally outward from guide track 114. Towards that end, support arm 133 includes a first end section 144 having a glide member 146, a second, cantilevered, end section 148 and an intermediate section 150. Glide member 146 allows support arm 133 to easily shift along glide track 114 in order to establish a desired spacing to make multiple bags available for receiving and holding products as will be discussed more fully below.

In accordance with the exemplary embodiment shown in FIG. 3, collapsible bag holder 104 includes a plurality of bags 204-208 mounted on support arms 133-138. More specifically, bag 204 is mounted on support arm 133 and adjacent support arm 134; bag 205 is mounted on support arm 134 and adjacent support arm 135; bag 206 is mounted on support arm 135 and adjacent support arm 136; bag 207 is mounted on support arm 136 and adjacent support arm 137; and bag 208 is mounted on support arm 137 and adjacent support arm 138. With this configuration, as each bag is filled, a new bag can be mounted to bag holder 104. Moreover, the bag that is filled is shifted along guide track 114, thus allowing the new bag to be positioned centrally at bagging platform 30. In accordance with the embodiment shown, as the number of bags required during the transaction grows, full bags are shifted around a side portion of housing 4 to provide additional space for new bags. In this manner, bags are spread out in an array or fan-like pattern along guide track 114 and consumers are no longer limited to a single bag or, when multiple bags are needed, no longer require assistance from store personnel to complete a transaction. Thus, checkout station 2 has a relatively small footprint while still providing access to multiple bags during a transaction. It should be appreciated at this point that while the checkout station is shown and described in connection with a self-service terminal, the collapsible multiple bag holder can be readily employed at manned checkout stations to provide cashiers with greater storage flexibility when scanning and bagging purchased items.

While exemplary embodiments of the invention have been described, it will be understood that those skilled in the art, both now and in the future, may make various improvements and enhancements which fall within the scope of the claims which follow. These claims should be construed to maintain the proper protection for the invention first described.

The invention claimed is:

1. A retail checkout station comprising:

a housing having at least a front wall, a first side wall and a second side wall;

a product scanning portion mounted to the housing, the product scanning portion including a scanning device for scanning products purchased by a consumer;

a user interface portion provided on the housing, the user interface portion including a display; and a multiple arm bag holder including a continuous guide track mounted to at least two of the front wall, the first side wall and the second side wall of the housing, the guide track having a first end portion that extends to a second end portion through a curved portion, and a plurality of bag support arms shiftably mounted to the guide track, the plurality of bag support arms extending outward from the guide track and being adapted to support a plurality of bags for holding items scanned at the product scanning portion.

2. The retail checkout station according to claim 1, further comprising: a bagging platform including a scale, the collapsible multiple arm bag holder being operatively connected to the scale.

3. The retail checkout station according to claim 2, further comprising: a bag suspended from adjacent ones of the plurality of bag support arms, said scale being adapted to determine a weight of products placed within the bag.

4. The retail checkout station according to claim 3, further comprising:

another bag suspended from one of the adjacent ones of the plurality of bag support arms and another of the plurality of bag support arms, the scale being adapted to determine a weight of products placed within the bag and the another bag.

* * * * *